United States Patent [19]

Boulton

[11] 4,121,990

[45] Oct. 24, 1978

[54] ELECTROLYTIC CELL

[75] Inventor: Thomas Wesley Boulton, Runcorn, England

[73] Assignee: Imperial Chemical Industries Limited, London, England

[21] Appl. No.: 818,862

[22] Filed: Jul. 25, 1977

[30] Foreign Application Priority Data

Sep. 20, 1976 [GB] United Kingdom ..... 38879/76

[51] Int. Cl.[2] ..... C25B 1/46; C25B 11/03; C25B 11/10

[52] U.S. Cl. ..... 204/258; 204/98; 204/128; 204/256; 204/263; 204/266; 204/283; 204/284; 204/286; 204/290 F

[58] Field of Search ..... 204/290 F, 283, 284, 204/263–266, 254–258, 296

[56] References Cited

U.S. PATENT DOCUMENTS

| | | | |
|---|---|---|---|
| 1,771,091 | 7/1930 | Lawaczeck | 204/283 X |
| 2,275,194 | 3/1942 | Sizelove | 204/284 |
| 3,632,497 | 1/1972 | Leduc | 204/263 |
| 3,676,315 | 7/1972 | Goens et al. | 204/95 |
| 3,930,981 | 1/1976 | DeNora et al. | 204/256 |
| 4,013,525 | 3/1977 | Emsley | 204/98 |

FOREIGN PATENT DOCUMENTS

| | | | |
|---|---|---|---|
| 687,237 | 2/1953 | United Kingdom | 204/283 |

*Primary Examiner*—F.C. Edmundson

*Attorney, Agent, or Firm*—Cushman, Darby & Cushman

[57] ABSTRACT

An anode suitable for use in a chlor-alkali diaphragm cell comprised of a pair of parallel slotted plates (e.g. louvred plates) mounted on a support, which are maintained at a fixed distance apart by means of a removable spacer adapted to engage the plates at their unsupported ends in combination with spacer studs located between the plates.

24 Claims, 3 Drawing Figures

ELECTROLYTIC CELL

This invention relates to improvements in electrolytic diaphragm cells.

More particularly, it relates to electrolytic diaphragm cells having anodes made from a film-forming metal and which carry an electrocatalytically-active coating. It especially relates to diaphragm cells for the electrolysis of aqueous solutions of alkali-metal halides.

A wide variety of diaphragm cells are known which consist in principle of a series of anodes and a series of cathodes disposed in a parallel alternating manner and separated from each other by a substantially vertical diaphragm. In cells of recent design the anodes are suitably in the form of plates of a film-forming metal (usually titanium) and carry an electrocatalytically-active coating (for example a platinum group metal oxide); the cathodes are suitably in the form of a perforated plate or gauze of metal (usually mild steel); and the diaphragms which are usually deposited on or fitted to the surface of the cathodes are suitably made of asbestos or a synthetic organic polymeric material for example polytetrafluoroethylene or polyvinylidene fluoride.

In operating a diaphragm cell, it is advantageous to operate with as small a distance as possible between the anode and the cathode (the anode/cathode gap) in order to keep the ohmic losses (and hence the cell voltage) to a minimum. At the same time it is desirable to operate at an economic current density, for example 2 $kA/m^2$.

The use of high current densities results in a high rate of evolution of gas (for example chlorine) during electrolysis and if this evolution takes place in a narrow anode/cathode gap, it can in turn cause a foam of gas and electrolyte. This foam can partially fill the anode/-cathode gap in the anolyte compartment, thus driving the electrolyte out of the gap and increasing the resistance to further electrolysis. This problem has been mitigated by using metal anodes provided with a plurality of vertically-disposed elongated members (e.g. blades, rods, channel-shaped members) to facilitate the removal of gas from the surface, for example as described in published Belgian Specification No. 820,245.

There is also known an anode of a film-forming metal or alloy thereof which comprises a lower solid plate portion and an upper portion comprising a plurality of elongated members, preferably in the form of louvres. The louvred portion facilitates removal of gas from the surface of the anode and enables low anode/cathode gaps to be used in the upper portion of the anodes thereby reducing the electrolytic resistance in this vicinity and so leading to a more even distribution of current up the anode and an improved current efficiency.

A desirable alternative to the half louvred/half solid plate metal anode would be a fully louvred anode i.e. an anode in which vertical louvres extend from the bottom to the top. In practice, however, it is difficult to manufacture fully louvred plates which are completely flat, and it is often necesssary to subject the plates to a flattening process in which the plates are pressed on to a heated flat surface, for example a heated silica block. Furthermore, the louvred plates may be distorted during the heating stage of the coating process (in which a paint composition is applied to the anode surface and subsequently fired).

We have now devised an anode which aims to obviate or mitigate the disadvantages associated with the aforesaid anodes.

According to the present invention we provide an anode comprising a pair of slotted plates of a film-forming metal or alloy thereof mounted on a support and carrying on at least part of their surfaces an electrocatalytically active coating, the slots extending lengthwise from the point of mounting, a removable spacer adapted to engage the plates at their unsupported ends so as to maintain the plates substantially parallel to one another and at a fixed distance apart, and one or more spacing studs located between the plates and attached to the back surface of one of the plates and adapted to engage the back surface of the other plate when the two plates are at their fixed distance apart.

According to a further aspect of the present invention we provide an electrolytic cell comprising a plurality of anodes, a plurality of cathodes and diaphragms separating the anodes and cathodes and wherein each anode is according to the invention.

The slotted plates are preferably in the form of louvres. The louvres of each anode plate are conveniently produced from a single sheet of film-forming metal by pressing with a slitting and forming tool. The louvres so obtained may suitably be turned at right angles to the original plane of the film-forming metal sheet, but they may be inclined to the plane if desired, or they may be rolled round to form a series of approximately hemicylindrical members which alternate with the slots from which the metal forming them has been pressed out. The louvres are preferably inclined at an angle of 60° to the plane of the sheet.

The support is preferably a bridge piece of a film-forming metal which mechanically and electrically connects the lower ends of each pair of louvred plates to one another, for example by resistance seam welding. The bridge piece is conveniently in the form of a rectangular block of film-forming metal, for example titanium. The bridge piece provides a permanent attachment between the slotted plates at the bottom only and the resulting flexibility of the attached plates enables the anode to be heated during coating without distorting the slotted surfaces. The bridge piece may be directly mounted on to the baseplate of the cell, or preferably mounted on studs of a film-forming metal (for example titanium) for example by argon arc welding, which studs have been pre-mounted on the baseplate, for example by capacitor discharge stud welding.

The film-forming metal baseplate may in turn be conductively bonded to a plate of iron or steel, for example a mild steel plate which serves as a conductor providing a low resistance electrical flow path between the anodes and copper connectors bolted to a side edge of the plate of iron or steel.

The removable spacer conveniently comprises a removable comb or clip, which engages the upper ends of one or more pairs of anode plates, thereby holding the plates parallel to one another and at the desired fixed distance apart. The comb or clip may suitably be of a plastics material, for example of polyvinylidene fluoride, or of a film-forming metal, for example titanium, which is conveniently in the form of a wire clip. A further advantage of the design of the anodes according to the invention is that the aforesaid spacer (for example a removable comb or clip) may be replaced by any convenient clamping means to protect the plates of the anode at their upper edges whilst assembling the anode into a cell, thereby reducing the risk of damage to the diaphragms.

The spacing studs are preferably made of a metal or alloy thereof, for example titanium. The studs are conveniently capacitor discharge stud welded to the back surfaces of the plates.

The use of the spacers and spacing studs to obtain the correct positioning of the plates offsets the slight curvature of the plates (especially louvred plates) as manufactured, and avoids the necessity of subjecting the plates to a further flattening process.

In this specification, by 'a film-forming metal' we mean one of the metals titanium, zirconium, niobium, tantalum or tungsten or an alloy consisting principally of one of these metals and having anodic polarisation properties which are comparable to those of the pure metal. It is preferred to use titanium alone or an alloy based on titanium and having polarisation properties comparable to those of titanium. Examples of such alloys are titanium-zirconium alloys containing up to 14% of zirconium, alloys of titanium with up to 5% of a platinum group metal such as platinum, rhodium or iridium and alloys of titanium with niobium or tantalum containing up to 10% of the alloying constituent.

The electrocatalytically active coating is a conductive coating which is resistant to electrochemical attack but is active in transferring electrons between electrolyte and the anode.

The electrocatalytically active material may suitably consist of one or more platinum group metals, i.e. platinum, rhodium, iridium, ruthenium, osmium, and palladium, and alloys of the said metals, and/or the oxides thereof, or another metal or a compound which will function as an anode and which is resistant to electrochemical dissolution in the cell, for instance rhenium, rhenium trioxide, magnetite, titanium nitride and the borides, phospides and silicides of the platinum group metals. The coating may consist of one or more of the said platinum group metals and/or oxides thereof in admixture with one or more non-noble metal oxides. Alternatively, it may consist of one or more non-noble metal oxides alone or a mixture of one or more non-noble metal oxides and a non-noble metal chloride discharge catalyst. Suitable non-noble metal oxides are, for example, oxides of the film-forming metals (titanium, zirconium, niobium, tantalum or tungsten), tin dioxide, germanium dioxide and oxides of antimony. Suitable chlorine-discharge catalysts include the difluorides of manganese, iron cobalt, nickel and mixtures thereof. Especially suitable electrocatalytically active coatings according to the invention include platinum itself and those based on ruthenium dioxide/titanium and ruthenium dioxide/tin dioxide/titanium dioxide.

Other suitable coatings include those described in our UK Patent No. 1,402,414 and UK Patent Application No. 49898/73 (Belgian Patent No. 149,867) in which a non-conducting particulate or fibrous refractory material is embedded in a matrix of electrocatalytically active material (of the type described above). Suitable non-conducting particulate or fibrous materials include oxides, carbides, fluorides, nitrides and sulphides. Suitable oxides (including complex oxides) include zirconia, alumina, silica, thorium oxide, titanium dioxide, ceric oxide, hafnium oxide, ditantalum pentoxide, magnesium aluminate (e.g. spinel $MgO.Al_2O_3$), aluminosilicates (e.g. mullite $(Al_2O_3)_3(SiO_2)_2$), zirconium silicate, glass, calcium silicate (e.g. bellite $(CaO)_2SiO_2$), calcium aluminate, calcium titanate (e.g. perovskite $CaTiO_3$), attapulgite, kaolinite, asbestos, mica, codierite and bentonite; suitable sulphides include dicerium trisulphide; suitable nitrides include boron nitride and silicon nitride; and suitable fluorides include calcium fluoride. A preferred non-conducting refractory material is a mixture of zirconium silicate and zirconia, for example zirconium silicate particles and zirconia fibres.

The anodes may be prepared by the painting and firing technique, wherein a coating of metal and/or metal oxide is formed on the anode surface by applying a layer of a paint composition comprising thermally-decomposable compounds of each of the metals that are to feature in the finished coating in a liquid vehicle to the surface of the anode, drying the paint layer by evaporating the liquid vehicle and then firing the paint layer by heating the coated anode, suitably at 250° to 800° C., to decompose the metal compounds of the paint and form the desired coating. When refractory particles or fibres are to be embedded in the metal and/or metal oxide of the coating, the refractory particles or fibres may be mixed into the aforesaid paint composition before it is applied to the anode. Alternatively, the refractory particles or fibres may be applied on to a layer of the aforesaid paint composition while this is still in the fluid state on the surface of the anode, the paint layer then being dried by evaporation of the liquid vehicle and fired in the usual manner.

The electrode coatings are preferably built up by applying a plurality of paint layers on the anode, each layer being dried and fired before applying the next layer.

The cathode may suitably be in the form of a perforated metal sheet or gauze. The cathode is preferably of mild steel.

The anode may be used in conjunction with any conventional diaphragm. Suitable diaphragms include those made of asbestos or a synthetic organic polymeric material, for example polytetrafluoroethylene or polyvinylidene fluoride.

The anode/cathode gap is suitably in the range 10 to 2mm, for example 6 mm.

The invention is especially applicable to diaphragm cells used for the manufacture of chlorine and alkali metal hydroxides by electrolysis of aqueous alkali metal chloride solutions, for example in diaphragm cells manufacturing chlorine and sodium hydroxide from sodium chloride solutions.

By way of example, an embodiment of the invention will now be described with reference to the accompanying drawings in which FIG. 1 is a diagrammatic view of a louvred anode according to the invention.

Figure 1:
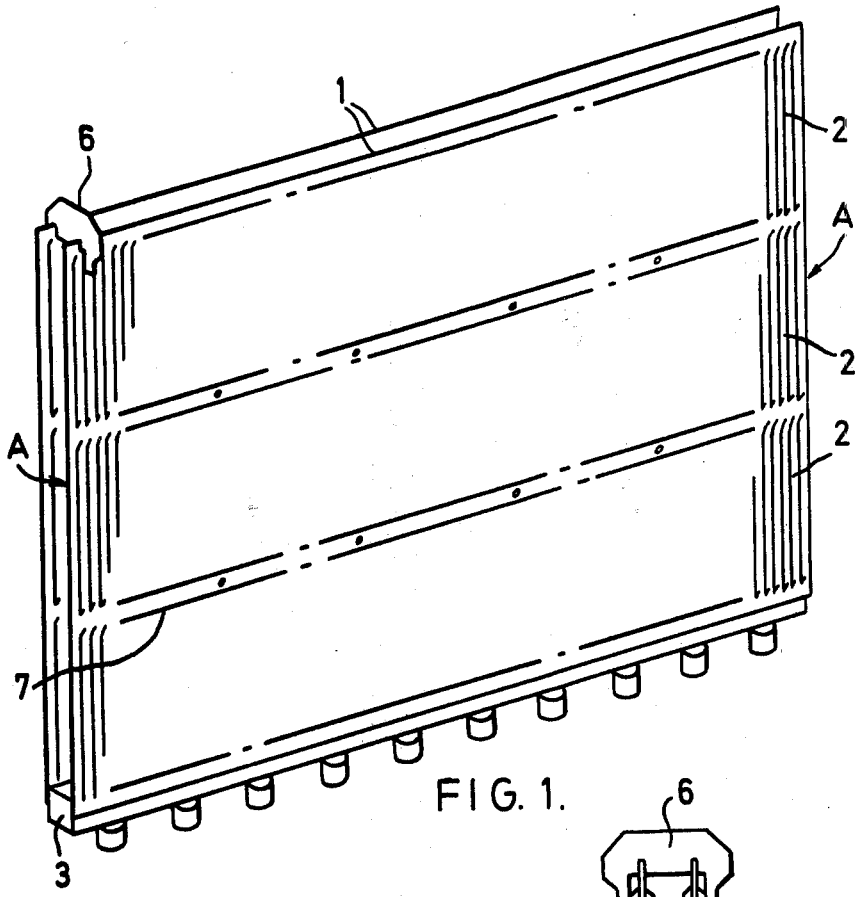
Figure 3:
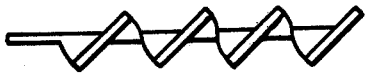
FIG. 3 is a section along the line A—A of FIG. 1.
Figure 2:
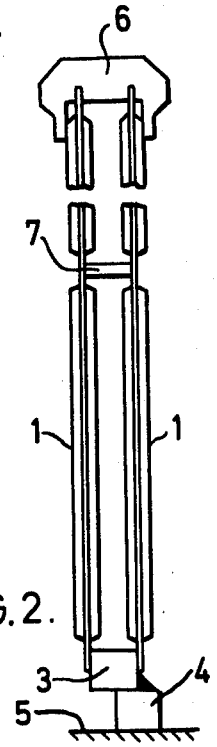
FIG. 2 is an end elevation of part of the anode.

Referring to the drawings, the anode comprises a pair of anode plates fabricated of titanium and each having three rows of vertical louvres 2, one above the other. The louvres 2 are formed by pressing out with a slitting and forming tool from a single sheet of titanium (of a size corresponding to the overall dimensions of the anodes).

The louvred anode plates are coated with an electrocatalytically active material, for example a coating comprising ruthenium oxide and titanium dioxide.

Each pair of anode plates 1 is resistance seam welded at their lower ends to a titanium bridge piece 3. The titanium bridge piece 3 is argon-arc welded to titanium studs 4 previously capacitor discharge stud welded to a titanium sheet 5 which serves as the base plate of the cell. The titanium base plate 5 is in turn conductively bonded to a mild steel slab (not shown) which serves as a conductor providing a low-resistance electrical flow path between the anodes 1 and copper connectors (not shown) bolted to a side edge of the mild steel slab.

The anode plates 1 are held apart in their correct position during use in the cell by means of a spacer 6 in the form of a removable comb or clip, preferably of plastics material such as polyvinylidene chloride, which fits over the upper ends of said plates, and by means of spacing studs 7, for example of titanium which are capacitor discharge stud welded to the back surface of one of the plates 1. The spacer 6 may also be in the form of a clip comprising a loop of titanium wire. Whilst assembling, the plates may, if desired, be protected at their upper edges by any convenient clamping means, for example a cover strip, preferably of plastics material, in order to reduce the risk of damage to the diaphragms.

The invention is further illustrated by the following Example:

EXAMPLE

A diagraphm cell was provided with one pair of louvred titanium anodes according to the invention, a mild steel gauze cathode and a polytetrafluoroethylene diaphragm and an anode/cathode gap of 6 mm. The polytetrafluoroethylene diaphragm was prepared by calendering a mixture of an aqueous polytetrafluoroethylene dispersion, titanium dioxide and starch, and subsequently removing the starch by electrolytic extraction in situ in the cell.

The cell was fed with sodium chloride brine (at a concentration of 310g/liter). A current of 400 amps was passed through the cell which corresponded to a current density of 2.0 $kA/m^2$ when compared with the effective area of the diaphragm. The cell operating voltage was 3.02 volts. The chlorine produced contained 98.0% chlorine and less than 2.0% oxygen. The aqueous sodium hydroxide produced contained 10% by weight of NaOH. The cell operated at a current efficiency of 96.08%.

What we claim is:

1. An anode comprising a pair of slotted plates of a film-forming meal or alloy thereof mounted on a support and carrying on at least part of their surfaces an electrocatalytically active coating, the slots extending lengthwise from the point of mounting, a removable spacer adapted to engage the plates at their unsupported ends so as to maintain the plates substantially parallel to one another and at a fixed distance apart, and one or more spacing studs located between the plates and attached to the back surface of one of the plates and adapted to engage the back surface of the other plate when the two plates are at their fixed distance apart.

2. An anode as claimed in claim 1 wherein the slotted plates are in the form of louvres.

3. An anode as claimed in claim 2 wherein the louvres are formed by pressing from a sheet of a film-forming metal or alloy thereof.

4. An anode as claimed in claim 2 wherein the louvres are inclined at 60° to the plane of the sheet.

5. An anode as claimed in claim 1 wherein the support is a bridge piece of a film-forming metal or alloy thereof.

6. An anode as claimed in claim 1 wherein the removable spacer comprises a comb or clip.

7. An anode as claimed in claim 6 wherein the comb or clip is of a plastics material.

8. An anode as claimed in claim 6 wherein the comb or clip is of a film-forming metal or alloy thereof.

9. An anode as claimed in claim 1 wherein the spacing studs are of a film-forming metal alloy thereof.

10. An anode as claimed in claim 1 wherein the film-forming metal is titanium.

11. An anode as claimed in claim 1 whenever coated with a mixture of a platinum metal oxide and a film-forming metal oxide.

12. An anode as claimed in claim 11 coated with a mixture of ruthenium oxide and titanium dioxide.

13. An electrolytic cell comprising a plurality of anodes, a plurality of cathodes and diaphragms separating the anodes and cathodes and wherein each anode is as claimed in claim 1.

14. A cell as claimed in claim 13 wherein the anode is mounted directly on the baseplate of the cell.

15. A cell as claimed in claim 13 wherein the anodes are mounted on studs of a film-forming metal or alloy thereof which studs have been premounted on the baseplate of the cell.

16. A cell as claimed in claim 14 wherein the baseplate is of a film-forming metal or alloy thereof.

17. A cell as claimed in claim 15 wherein the film-forming metal is titanium.

18. A cell as claimed in claim 13 wherein the anode/cathode gap is in the range from 2 to 10 mm.

19. A cell as claimed in claim 18 wherein the anode/cathode gap is 6 mm.

20. A cell as claimed in claim 13 wherein the cathode is of mild steel gauze.

21. A cell as claimed in claim 13 wherein the diaphragm comprises asbestos.

22. A cell as claimed in claim 13 wherein the diaphragm comprises polytetrafluoroethylene or polyvinylidene fluoride.

23. An electrolytic cell as claimed in claim 13 whenever used for the electrolysis of an aqueous alkali metal chloride solution.

24. An anode comprising a pair of parallel plates of a film-forming metal or alloy thereof mounted at one end on a support and having unsupported opposite ends, the plates carrying on at least part of their surfaces an electrocatalytically active coating, each of said plates having a plurality of louvres pressed out of the plate whereby the louvres alternate with slots, the slots and louvres extending lengthwise from the point of mounting, a removable spacer in the form of a comb or clip removably fitting over unsupported ends of the plates so as to maintain the plates substantially parallel to one another and at a fixed distance apart, and at least one spacing stud located between the plates intermediate their ends and attached to the back surface of one of the plates and adapted to engage the back surface of the other plate when the two plates are at their fixed distance apart.

* * * * *